US006162070A

United States Patent [19]

Yu et al.

[11] Patent Number: 6,162,070

[45] Date of Patent: Dec. 19, 2000

[54] GROUNDING PLATE FOR A CONNECTOR DEVICE

[75] Inventors: Hung-Chi Yu, Hsi-Chih Chen; Tsung-Hsi Ou Lee, Taipei, both of Taiwan

[73] Assignee: Hon Hai Precision Ind. Co., Ltd., Taipei Hsien, Taiwan

[21] Appl. No.: 09/172,398

[22] Filed: Oct. 13, 1998

[30] Foreign Application Priority Data

Oct. 13, 1997 [TW] Taiwan ..... 86217515

[51] Int. Cl.[7] ..... H01R 4/66; H01R 13/648

[52] U.S. Cl. ..... 439/108; 439/607

[58] Field of Search ..... 439/79, 607, 541.5, 439/608, 108, 80, 604

[56] References Cited

U.S. PATENT DOCUMENTS 5,954,522 9/1999 Ho et al. ..... 439/541.5

*Primary Examiner*—Paula Bradley
*Assistant Examiner*—Antoine Ngandjui

[57] ABSTRACT

A connector device having a grounding plate which is formed with a cut-out region so that an array of pin contacts may extend through without needing to bend the grounding plate to such a degree as to occupy a significant space on or above a mother board.

4 Claims, 11 Drawing Sheets

GROUNDING PLATE FOR A CONNECTOR DEVICE

BACKGROUND OF THE INVENTION

The present invention relates to a grounding plate for a connector device which can be used for a memory card or an I/O card to be connected to a mother board.

As the size reduction in a computer device is promoted, demand has arisen for decreasing the space a connector device occupies. FIG. 13 shows a prior art design having a connector device 5 connected to a mother board 2 through a circuit board adapter 51 and a header connector 21. While achieving a reduction in occupied space when compared to a connector device directly connected to a mother board, the connector device 5 requires a stand-off 52 to be disposed thereunder, thereby increasing a total height of the assembly.

FIG. 14 shows another prior art design having a connector section 6 of a connector device equipped with a grounding plate 63 connected to a mother board 2 through a circuit board adapter 61 and a header connector 21. In this design, no stand-offs are used, but the grounding plate 63 and the pin contact arrays 611 arranged in the connector section 6 must be angled in order to be suitably connected to the circuit board adapter 61 to perform its intended purpose of grounding. The configuration of the grounding plate 63 and the circuit board adapter 61 unavoidably increases the occupied space of the connector device. This is also true for a design having all of the components mounted to a reverse side of the mother board 2, as shown in FIG. 15. The grounding plate 64 and therefore the pin contact arrays 611 are angled in order to be suitably connected to the circuit board adapter 62.

The present invention aims to provide an improved grounding plate for reducing the occupied space of a connector device.

BRIEF SUMMARY OF THE INVENTION

The main object of the present invention is to provide a connector device which comprises a connector section, an array of pin contacts mounted to the connector section and a grounding plate secured to the connector section, the grounding plate having a cut-out region for the array of pin contacts to extend through.

According to one embodiment of the invention, the grounding plate forms an edge and a pair of contacting pins on opposite ends of the edge which together define a cut-out region and leftmost and rightmost pin contacts of the array of pin contacts connect with the pair of contacting pins.

According to another embodiment of the invention, the grounding plate has a main portion and a rectangular frame defining four peripheral sides and the cut-out region. A plurality of contacting pins are formed on the side which is distal from the main portion and are adapted to contact a circuit board adapter.

Other objects, advantages and novel features of the invention will become more apparent from the following detailed description when taken in conjunction with the accompanying drawings.

DETAILED DESCRIPTION OF THE INVENTION

Figure 1:
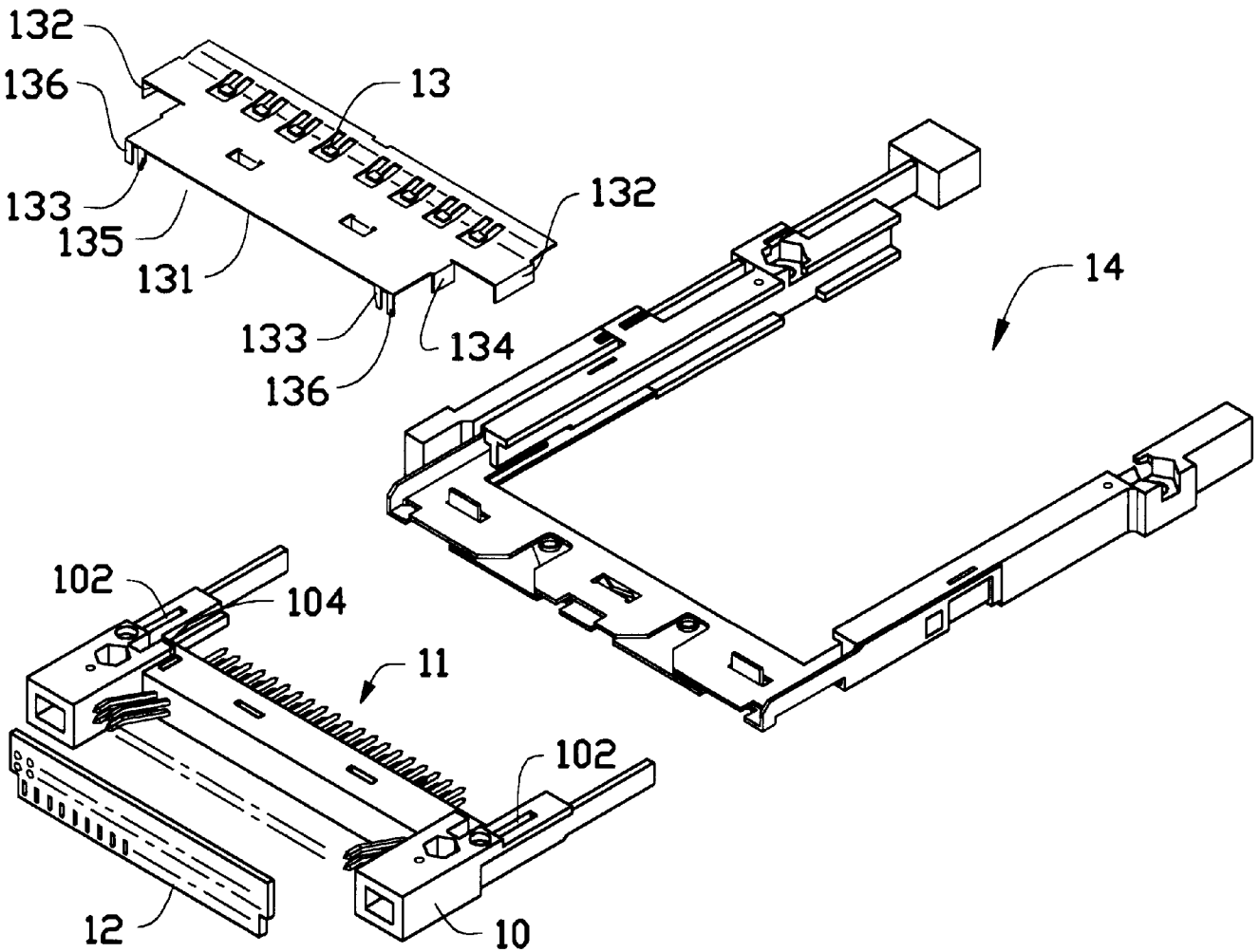
FIG. 1 is an exploded perspective view of a connector device incorporating a grounding plate constructed in accordance with a first embodiment of the present invention.

Referring now to the drawings and initially to FIGS. 1 through 8 which show a first embodiment of the present invention.

As shown in FIG. 1, a connector device generally comprises a connector section 10, an array of pin contacts 11 mounted to the connector section 10 and an ejector mechanism 14. The ejector mechanism 14 is suitably connected with the connector section 10 and is of a general type thus a detailed description thereof is omitted. Also included in the connector device of the invention are a circuit board adapter 12 for cooperating with the array of pin contacts 11 and a grounding plate 13 securely mounted to the connector section 10 and cooperating with certain contacts of the array of pin contacts 11 in a manner as will be described later.

Figure 2:
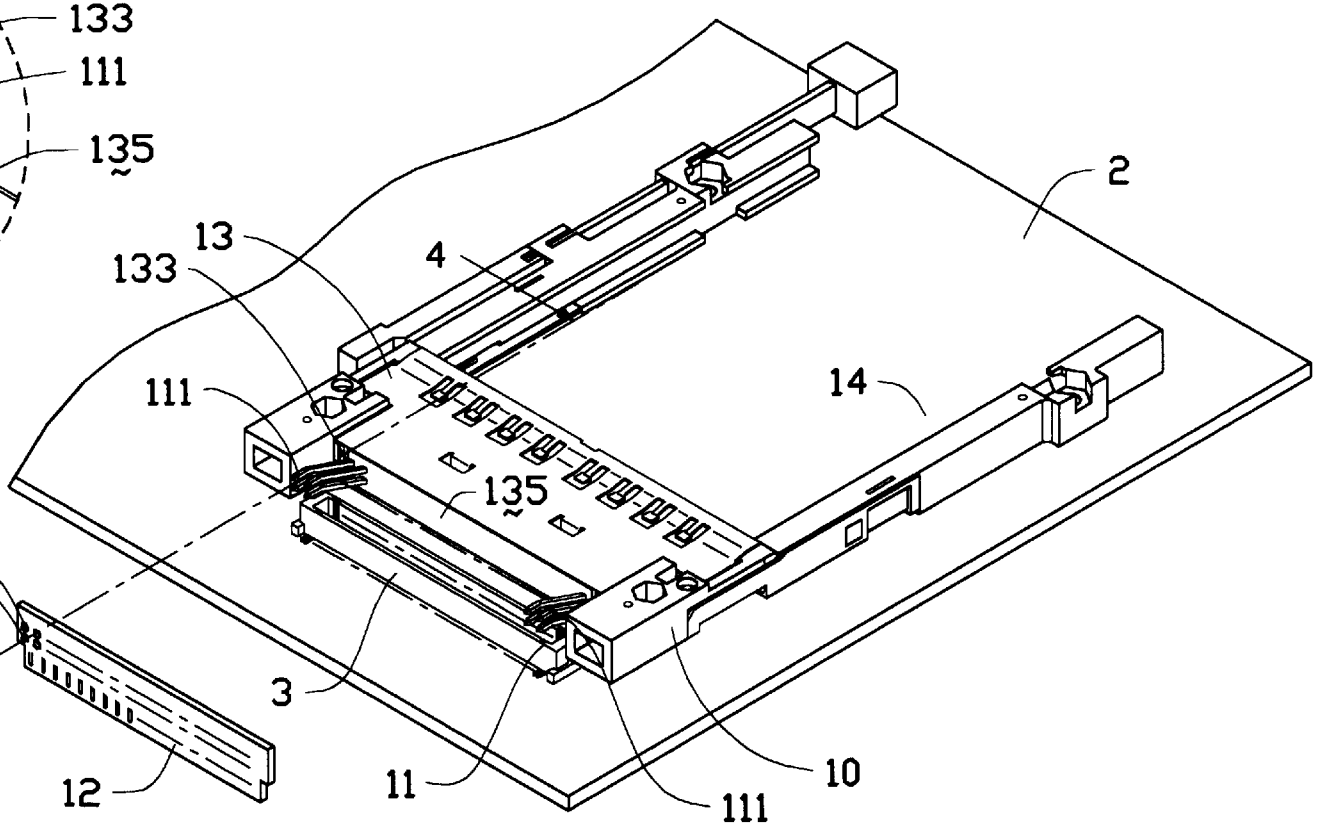
FIG. 2 gives an assembled perspective view of the connector device of FIG. 1 mounted to a mother board.
Figure 3:
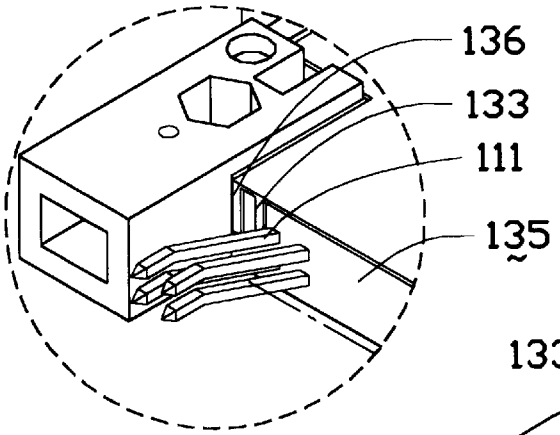
FIG. 3 is an enlarged, partial view of FIG. 2 showing the configuration of the grounding plate and an array of contact pins.

The grounding plate 13 has two pairs of bending portions 132, 134 for inserting into corresponding slits 102, 104 defined in the connector section 10. The grounding plate 13 further forms an edge 131 and a pair of contacting pins 133 on opposite ends of the edge 131. The edge 131 and the pair of contacting pins 133 together define a cut-out region 135. A pair of positioning pins 136 may be further formed adjacent to and outwardly of the pair of contact pins 133 for structural strength and ease of manufacturing considerations. FIG. 2 shows the ejector mechanism 14 connected to the connector section 10 and both are then mounted to a mother board 2. The circuit board adapter 12 will be mechanically and electrically connected to the array of pin contacts 11 and then an electrical connection between the circuit board adapter 12 and the mother board 2 will be established through a header 3. As clearly shown in FIGS. 3 and 4, a leftmost and a rightmost pin contacts 111 of the array of pin contacts 11 contact with the pair of contacting pins 133. Since the upper leftmost and rightmost pin contacts 111 being of grounding pin contacts, are electrically connected to a common grounding circuit of the circuit board adapter 12 through solder pads 122 in accordance with the PC card standard, the above-mentioned contact or connection between the upper leftmost and rightmost pin contacts 111 and the pair of contacting pins 133 serves to ground the grounding plate 13 while the array of pin contacts 11 passes through or extends into the cut-out region 135 without the need to bend the grounding plate 13.

Figure 6:
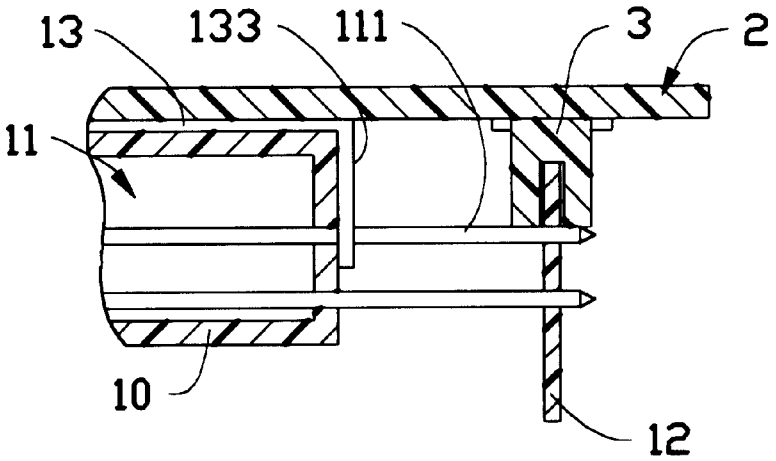
FIG. 6 is a cross-section taken along line 6—6 of FIG. 5.
Figure 4:
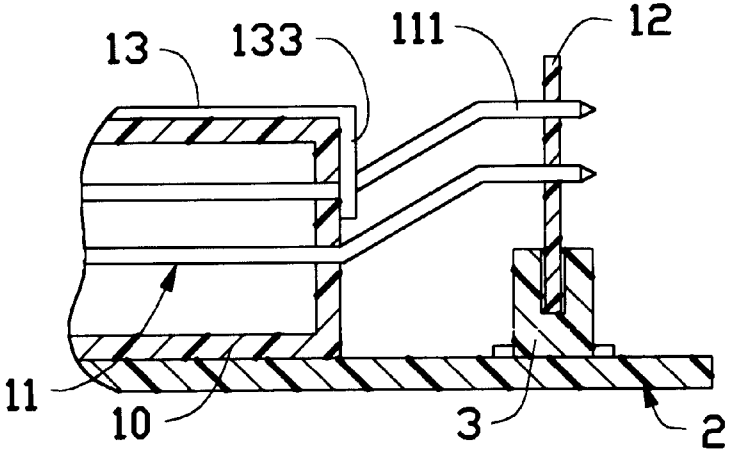
FIG. 4 is a cross-section taken along line 4—4 of FIG. 2.
Figure 5:
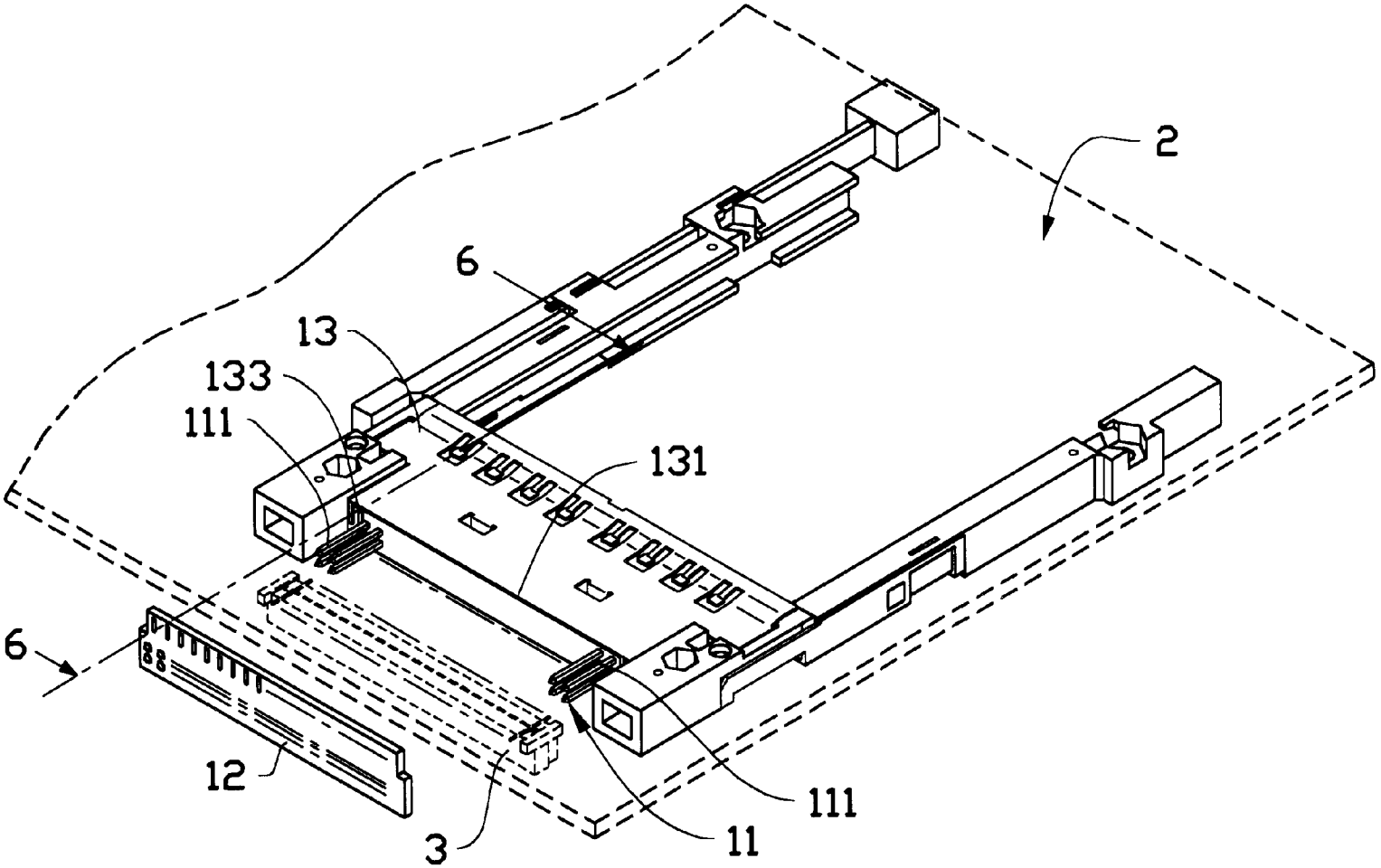
FIG. 5 is a view similar to FIG. 2 except the assembled connector device is mounted on a reverse side of the mother board.

FIGS. 5 and 6 show a variation of the first embodiment of the invention in which the connector device is mounted to a reverse side of the mother board 2. In this arrangement, except for the angle of the array of pin contacts 11 which is adapted to the upside-down orientation of the header 3 and the circuit board adapter 12, the configuration of the grounding plate 13, the connector section 10 and the array of pin contacts 11 essentially remains the same and, therefore, same reference numerals will be used to denote like elements. It is noted that the edge 131 of the grounding plate 13 may be located at a position lower than that shown in FIG. 3, as long as the edge 131 is spaced a distance from the array of pin contacts 11 to avoid contact therethrough. In such a case, the edge 131, the contacting pins 133 and the cut-out region 135 will constitute part of a bend-down portion of the grounding plate 13.

Figure 7:
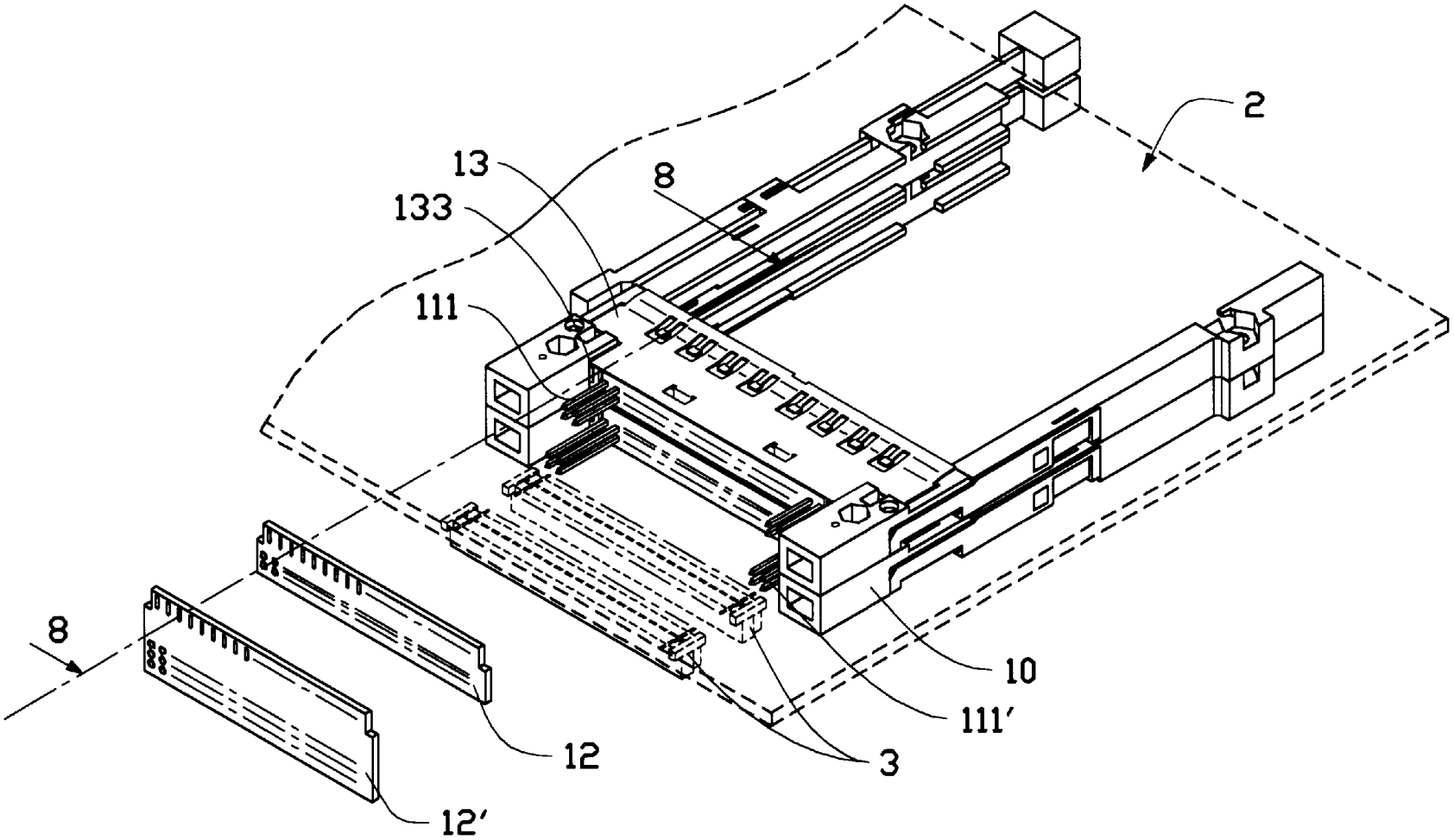
FIG. 7 gives an assembled perspective view of a pair of stacked connector devices of FIG. 1 mounted to a mother board.
Figure 8:
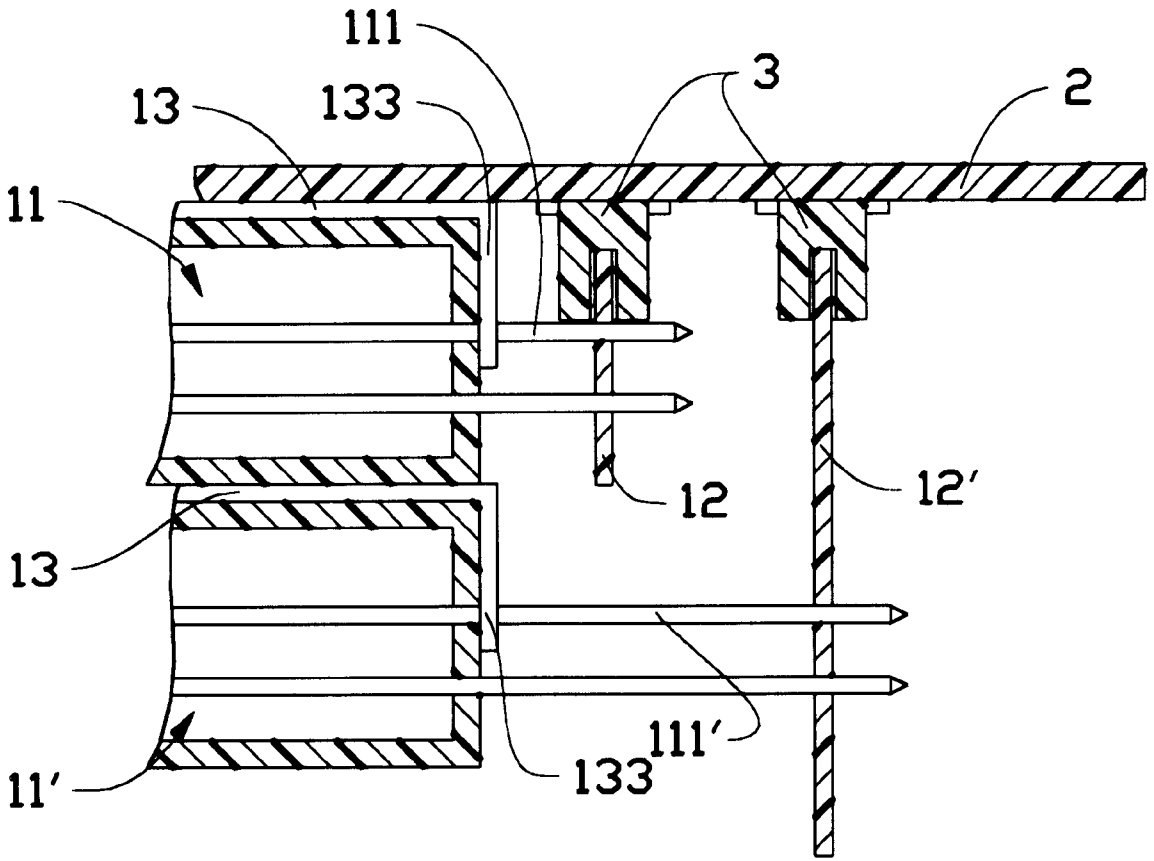
FIG. 8 is a cross-section taken along line 8—8 of FIG. 7.
Figure 9:
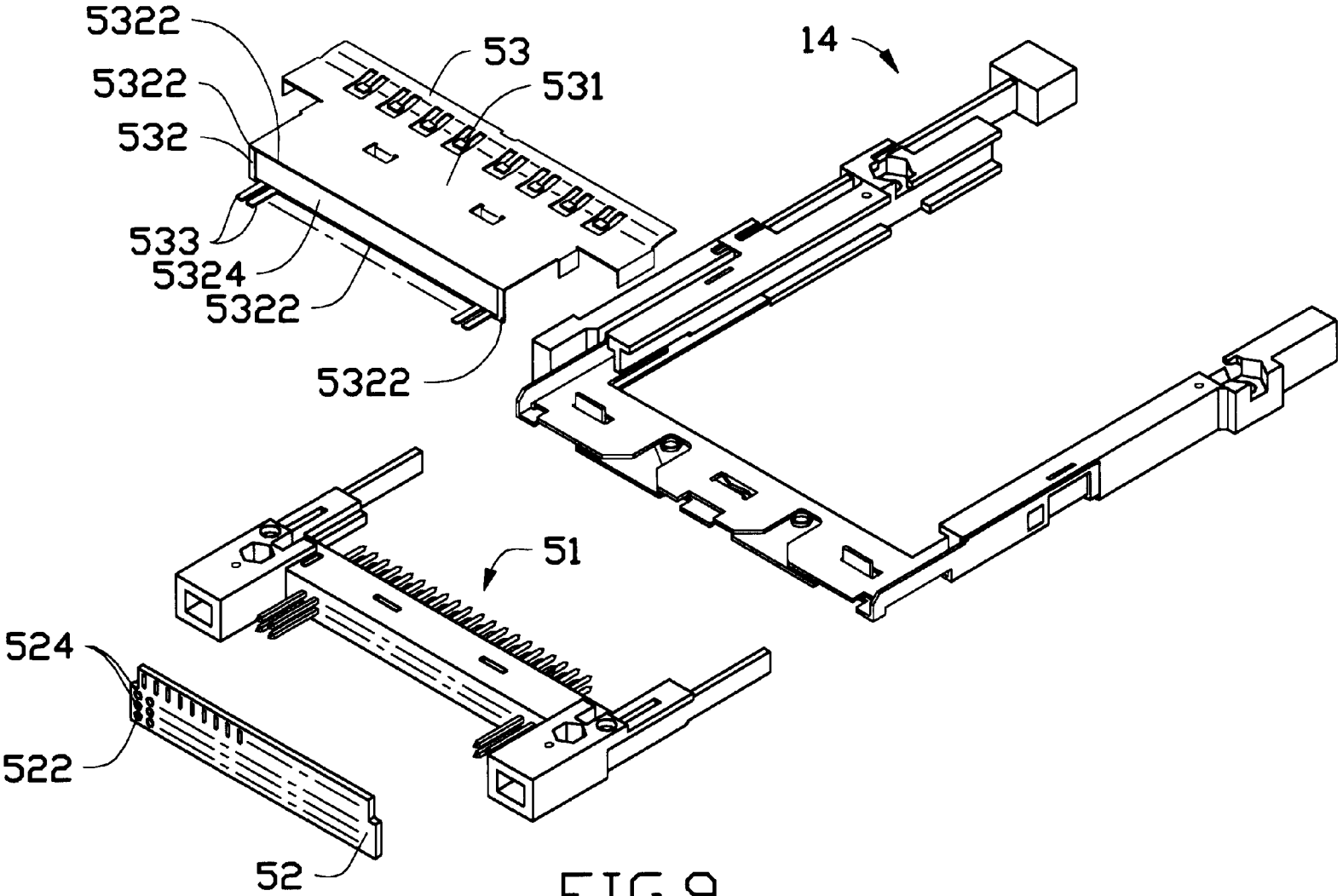
FIG. 9 is an exploded perspective view of a connector device incorporating a grounding plate constructed in accordance with a second embodiment of the present invention.
Figure 10:
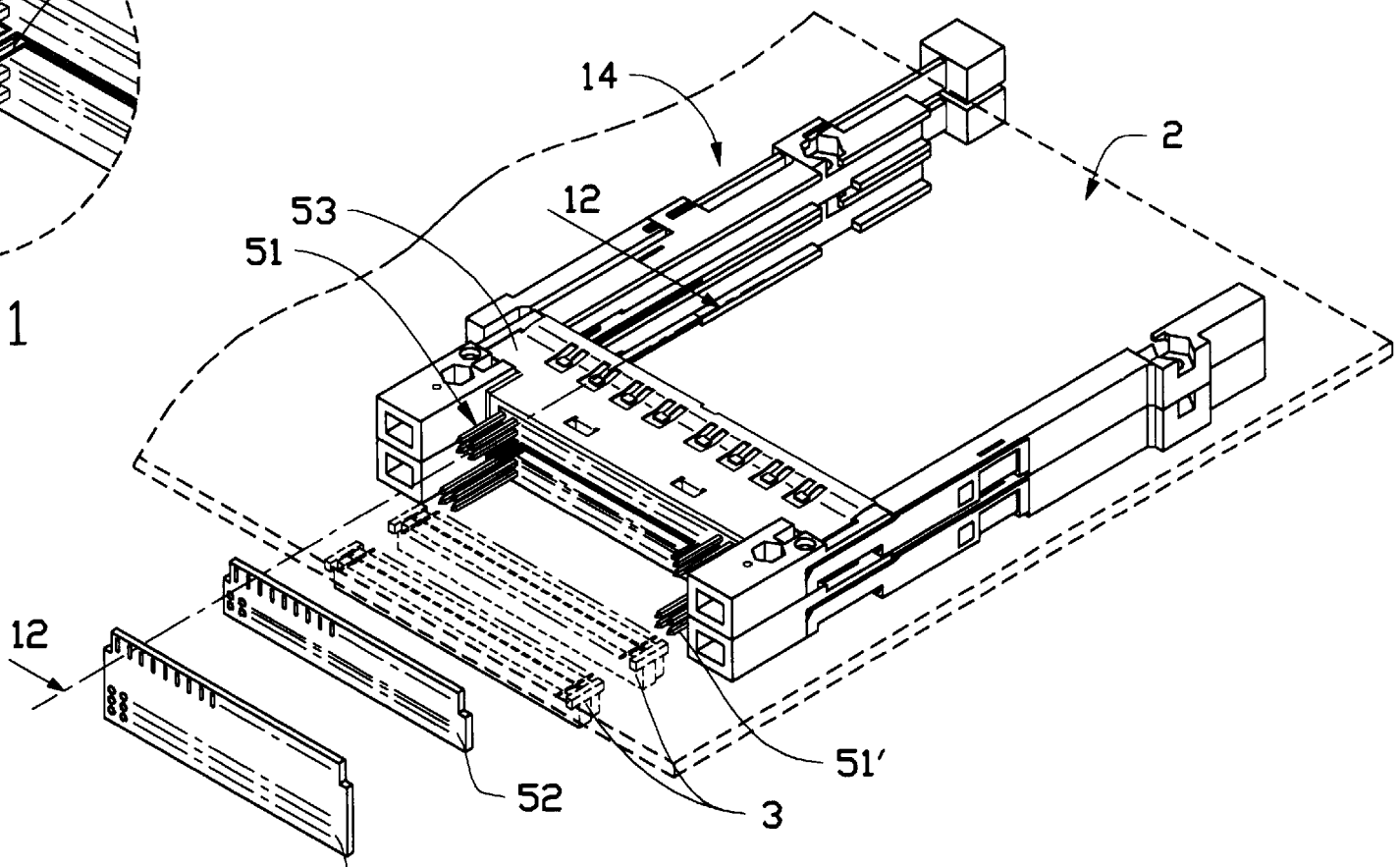
FIG. 10 gives an assembled perspective view of the connector device of FIG. 9 mounted to a reverse side of a mother board.

FIGS. 7 and 8 show another variation of the first embodiment of the invention in which two connector devices 10 are stacked one above the other and then mounted to a reverse side of the mother board 2. This arrangement is similar to the first variation except for the length of the upper rightmost and leftmost pin contacts 111' of the array 11' and the width of the circuit board adapter 12'. However, functional structures remain the same for both variations.

Turning now to FIGS. 9 through 12 which show a second embodiment of the present invention. In this connector device, only the grounding plate 53 and the circuit board adapter 52 are modified and therefore need to be described.

Figure 11:
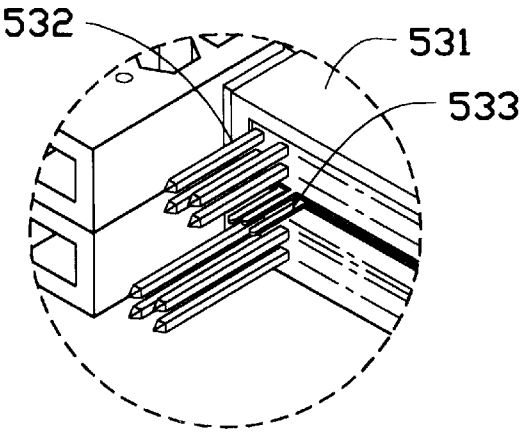
FIG. 11 is an enlarged, partial view of FIG. 10 showing the configuration of the grounding plate and an array of contact pins.

The grounding plate 53 has a main portion 531 and a rectangular frame 532 (best shown in FIG. 11). The rectangular frame 532 defines four peripheral sides 5322 and a central cut-out region 5324. The main portion 531 and the rectangular frame 532 are formed from a metal sheet. The rectangular frame 532 is then stamped to form the cut-out region 5324 and bent to be substantially perpendicular to the main portion 531. The grounding plate 53 further has a plurality of contacting pins 533 formed on the side which is distal from the main portion 531. In assembly, the contacting pins 533 extend through the cut-out region 5324 of the rectangular frame 532 to contact solder pads 522 formed on the circuit board adapter 52. Solder pads 524 are also provided on the circuit board adapter 52 for contacting or reception of an array of pin contacts 51. It is noted that the solder pads 524 are part of a grounding circuit on the circuit board adapter 52 so that the grounding plate 53 can be grounded as desired.

Figure 12:
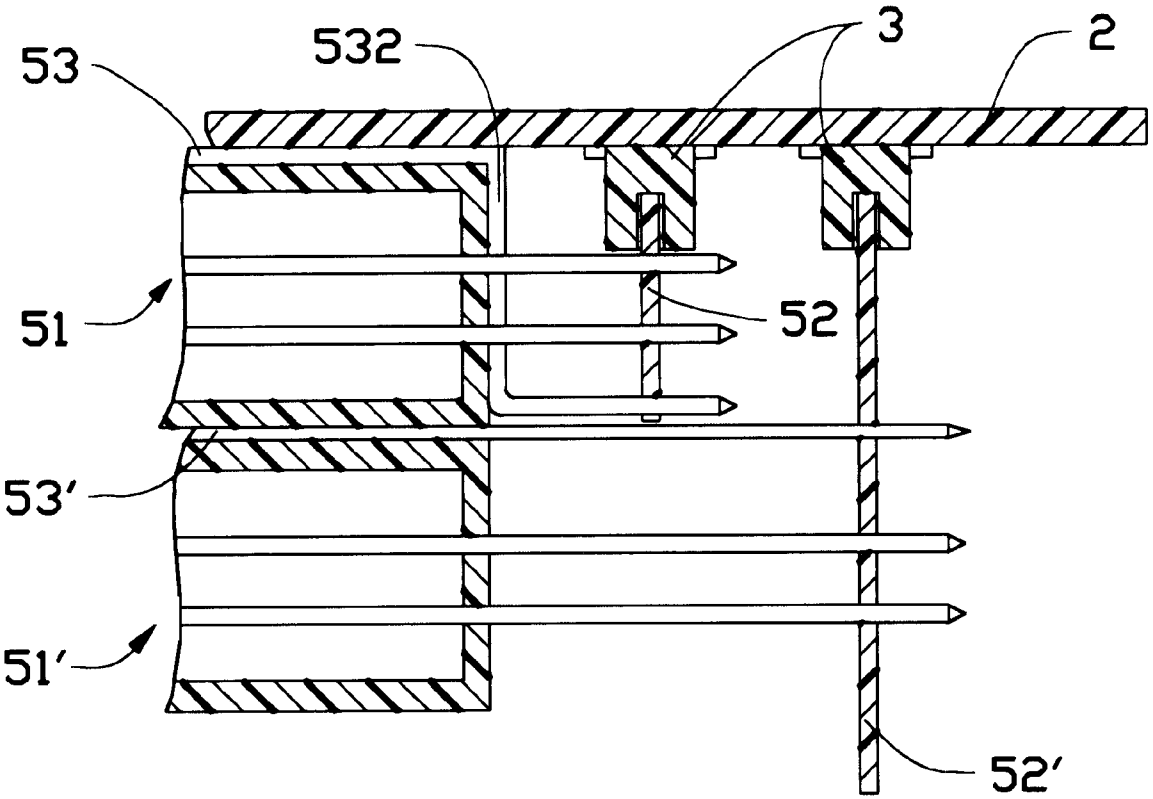
FIG. 12 is a cross-section taken along line 12—12 of FIG. 10.
Figure 13:
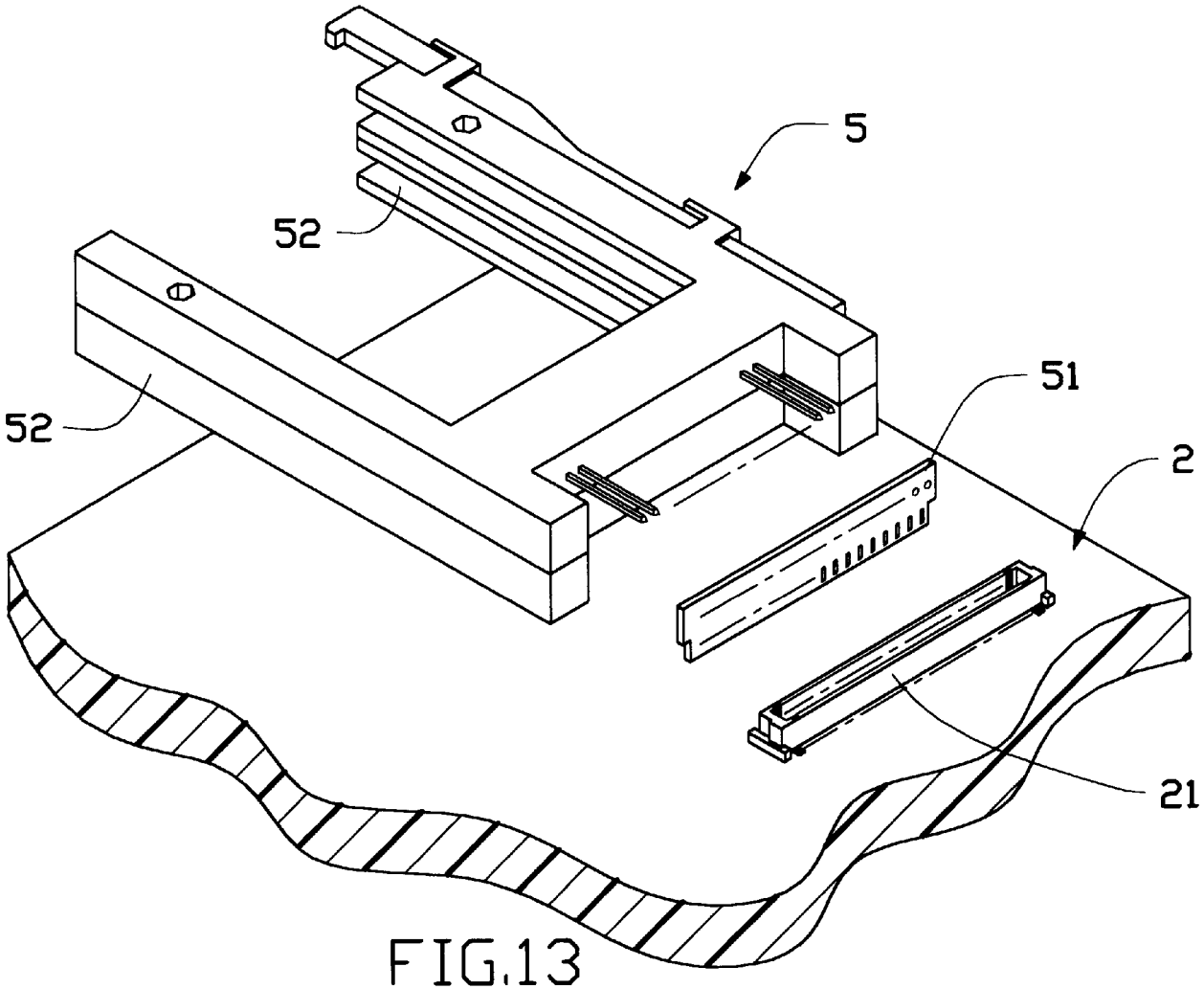
FIG.13 (PRIOR ART)
FIG. 13 shows a prior art connector device.
Figure 15:
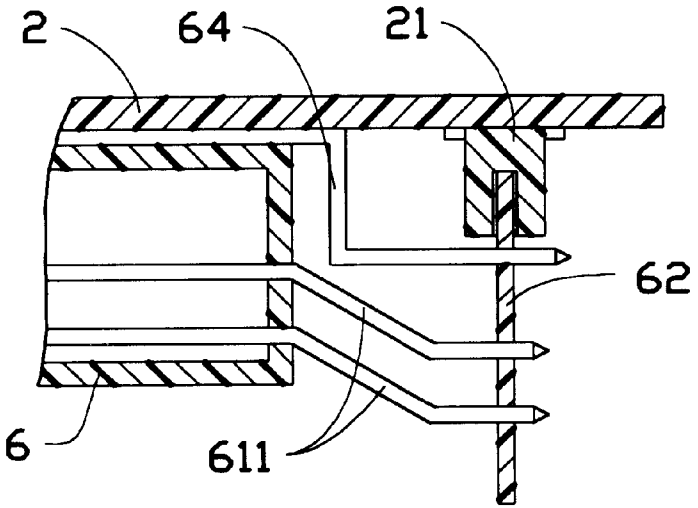
FIG.15 (PRIOR ART)
FIG. 15 shows a further prior art connector device.
Figure 14:
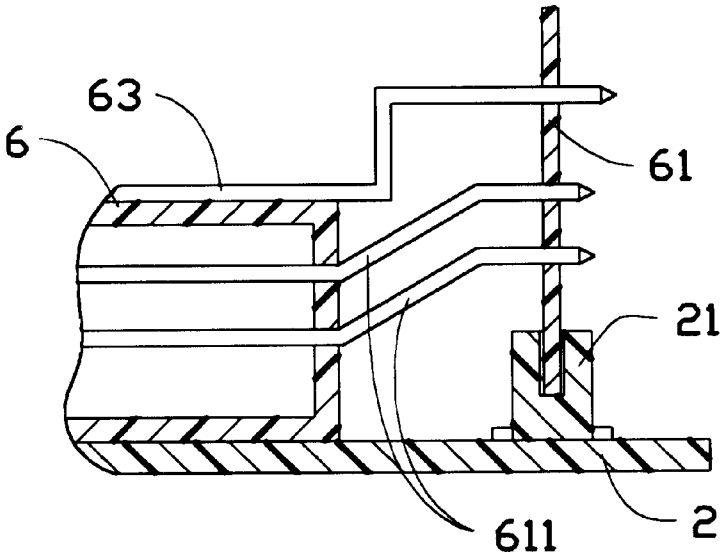
FIG.14 (PRIOR ART)
FIG. 14 shows another prior art connector device.

In FIG. 12, the connector device incorporates the grounding plate 53 and is stacked with a connector device having a planar grounding plate 53'. Since the grounding plate 53 does not obstruct the normal arrangement of the array of pin contacts 51, the space occupied by the stacked connector devices can be reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector device comprising a connector section, an array of pin contacts mounted to the connector section and a grounding plate secured to the connector section, the array of pin contacts being adapted to electrically connect with a circuit board adapter, the grounding plate forming an edge and having a pair of contacting pins on opposite ends of the edge, the edge and the contacting pins together defining a cut-out region for the array of pin contacts to extend therethrough, wherein a leftmost and a rightmost pin contacts of the array of pin contacts respectively make contact with the pair of contacting pins of the grounding plate.

2. The connector device as claimed in claim 1, wherein a respective positioning pin is provided adjacent to and outwardly of the pair of contact pins to provide structural strength and to ease manufacturing.

3. The connector device as claimed in claim 1, wherein:

the ground plate is secured to the connector section and has a main portion and a rectangular frame, the rectangular frame defining four sides and the cut-out region; and a plurality of contacting pins are formed on the side of the grounding plate which is distal from the main portion, the contacting pins straightly extending parallel to the array of pin contacts for groundingly connecting with the circuit board adapter.

4. The connector device as claimed in claim 3, wherein:

the main portion and the rectangular frame are integrally formed and the main portion is substantially perpendicular to the rectangular frame.

* * * * *